US005320469A

United States Patent [19]

Katou et al.

[11] Patent Number: 5,320,469

[45] Date of Patent: Jun. 14, 1994

[54] CAN SEAMER

[75] Inventors: Naoyoshi Katou; Hirofumi Itoh; Seiki Tamiya; Masateru Takahara, all of Nagoya, Japan

[73] Assignees: Mitsubishi Jukogyo Kabushiki Kaisha, Tokyo; Churyo Engineering Kabushiki Kaisha, Aichi, both of Japan

[21] Appl. No.: 953,788

[22] Filed: Sep. 30, 1992

[30] Foreign Application Priority Data

Oct. 30, 1991 [JP] Japan ..... 3-310200
Oct. 30, 1991 [JP] Japan ..... 3-310201
Oct. 30, 1991 [JP] Japan ..... 3-310202

[51] Int. Cl.[5] ..... B21D 51/00

[52] U.S. Cl. ..... 413/27; 413/31; 53/334; 53/340

[58] Field of Search ..... 493/30, 34, 308; 413/27, 31, 36, 78, 26; 53/334, 338, 340, 337, 52, 77

[56] References Cited

U.S. PATENT DOCUMENTS 2,447,524 8/1948 Nordquist ..... 53/334
2,540,001 1/1951 Laxo ..... 413/31
2,748,733 6/1956 Pechy ..... 413/31
3,025,814 3/1962 Currie ..... 413/31
4,820,100 4/1989 Riviere ..... 413/31
4,961,300 10/1990 Mihara ..... 413/27

*Primary Examiner*—Jack Lavinder
*Attorney, Agent, or Firm*—Wenderoth, Lind & Ponack

[57] ABSTRACT

In a can seamer, after a control mode of a drive motor has been switched to a type-changing mode, if an action button is depressed, in response to signals issued from a rotational position sensor, the drive motor moves can seaming mechanisms one pitch by one pitch via a center shaft and stops at predetermined positions. At the stopped position, an actuator is operated to depress the top end of a seaming roll shaft. By this operation, a gap clearance is formed between a rotary frame and a seaming lever. Then seaming rolls are dismounted and replaced. The seaming lever connected with a seaming chuck via a bracket is removed, and thereby a type-changing work can be carried out. In addition, in the type-changing work of the can seamer, the vertical positional adjustment in a fitting between a seaming lever and seaming rolls is easily carried out. Furthermore, the knock-out pad can be replaced in a one-touch operation.

9 Claims, 12 Drawing Sheets

CAN SEAMER

BACKGROUND OF THE INVENTION

1. Field of the Invention

The present invention relates to a can seamer in a can filling line, and more particularly, to a can seamer provided with means for facilitating replacement of seaming rolls, a seaming chuck and a knockout pad required as a result of changing the can size, or the like.

2. Description of the Prior Art

At first, the construction and operation of a conventional can seamer in the prior art will be described with reference to FIGS. 1 to 14. FIGS. 11 to 13 illustrate a structure of the seaming chuck and seaming rolls in a can seamer in the prior art, FIG. 11 is a plan view of a seaming mechanism in a conventional rotary seamer, FIG. 12 is a side view of seaming rolls, and FIG. 13 is a vertical cross-sectional view of a seaming mechanism. In these figures, reference numeral 11 designates a first seaming roll, numeral 12 designates a second seaming roll, and numeral 13 designates a seaming chuck. In addition, reference numeral 14 designates a seaming lever, inserted around a seaming roll shaft 15 via splines (serrations) 15*a*, which seaming lever 14 can be extracted downwards, but which is fixed to the shaft 15 so as to be integrally rotatable therewith to the lever 14 is fixed a shaft 16. Each of the seaming rolls 11 and 12 is rotatably suspended at the center of the shaft 16 via a bearing 18 fixed to the shaft 16 by means of a screw 17. On the other hand, the seaming chuck 13 is mounted via splines (or serrations) 22 to the bottom end of a rotary cylinder 21, which is rotatably supported from a rotary frame 19 via a bearing 20 so that the seaming chuck 13 can rotate integrally with the same rotary cylinder 21. A knock-out rod 23 extends within the rotary cylinder 21 so as to be slidable in the vertical direction. Reference numeral 27 designates a connecting bracket, which integrally connects the seaming lever 14 and the seaming chuck 13. More particularly, the bracket 27 is connected with the seaming chuck 13 via flanges 28 provided along its outer circumference, and is connected with the seaming lever 14 via a ring 29, and this ring 29 is rotatably fixed by means of a lock nut 30 engaged with the connecting bracket 27. In addition, reference numeral 31 designates a bolt for positioning the seaming chuck 13 in the vertical direction with respect to the rotary cylinder 21.

At the time of seaming a can, normally the can exerts a push-up force upon the seaming chuck 13 a push-up force, and the seaming rolls 11 and 12 also exert a reaction force generated upon pushing a can lid during the operation of seaming a can, and are thus pushed upwards. In addition, in order to prevent the seaming lever 14 from slipping out of the seaming roll shaft 15, a cam 35 rotatable about a shaft 37 mounted to the seaming lever 14 is provided. By rotating a lever 36, the cam 35 is made to enter a notch groove provided on the seaming roll shaft 15 to serve as a stopper.

On the other hand, the top end of the seaming chuck 13 butts against a flange of the rotary cylinder 21, and this rotary cylinder 21 is rigidly supported in the vertical direction with respect to a seamer main body via a bearing 20. Furthermore, with regard to the structure of the seaming roll shaft 15, for the sake of convenience, description will be made with reference to FIG. 1. Since the seaming roll shaft 15 is pushed upwards by means of a compression spring 43 via a cam lever 39, when the seaming lever 14 supporting the seaming rolls 11 and 12 is fixed to the seaming roll shaft 15, its top end butts against a washer 38 mounted to the rotary frame 19 (shown at E). Also, between the cam lever 39 and the rotary frame 19 is formed a gap space F.

By means of the above-mentioned arrangement, the vertical positions of the seaming chuck 13 and the seaming rolls 11 and 12 can be insured. It is to be noted that in FIG. 1, reference numeral 41 designates a cam follower, numeral 42 designates a seamer main body frame, numeral 42*a* designates a cam groove, and when a can seaming mechanism rotates, as a result of the action of the cam groove 42*a* and the cam follower 41, the seaming roll shaft 15 rotates, hence the seaming lever 14 swings, and the seaming rolls 11 and 12 alternately perform seaming operations.

Next, description will be made of operations for changing a type of cans. When it is necessitated to replace the seaming rolls 11 and 12 and the seaming chuck 13 in response to change in can lid diameter, under the condition where a can is not present, the can seamer is rotated to move the seaming rolls up to a position where working is easy, the top end of the seaming roll shaft 15 is depressed by means of a tool, and after a gap space has been formed between the seaming lever 14 and the washer 38, the bolt 31 is loosened. Simultaneously therewith, the cam 35 is disengaged from the notch groove in the seaming roll shaft 15 by turning the lever 36, and the seaming rolls 11 and 12 and the seaming chuck 13 are pulled down, gripped by hands. Then, since the seaming lever 14 and the seaming chuck 13 are integrally connected by the connecting bracket 27, the seaming lever 14 is disengaged from the seaming roll shaft 15 via the splines 15*a*, and the seaming chuck 13 is disengaged from the rotary cylinder 21 via the splines 22, and they are integrally pulled down via the connecting bracket 27.

Subsequently, when it is intended to mount a seaming lever having seaming rolls of changed sizes and a seaming chuck of changed a changed size, since the spline diameters are identical to those of the used lever and chuck, after the splines of the seaming lever 14 are aligned with the splines 15*a* of the seaming roll shaft 15, the splines of the seaming chuck 13 are aligned with the splines 22 of the rotary cylinder 21, and they are pushed in, the seaming chuck 13 is fixed by fastening the bolt 31, the seaming lever 14 is fixed to the seaming roll shaft 15 by turning the lever 36 to insert the cam 35 into the notch groove in the seaming roll shaft 15, and if a depressing force is removed from the top end of the same shaft 15, the mounting work is finished.

Another example of a can seamer in the prior art is seen in Laid-Open Japanese Utility Model Specification No. 54-9137 (1979), and in the following, this will be explained with reference to FIG. 14. In this figure, reference numeral 101 designates seaming rolls, which are rotatably mounted around respective shafts 103 and 104 fixed to a seaming lever 102. Reference numeral 105 designates a seaming chuck, which is threadedly fixed to a bottom end of a rotary cylinder 106, and a knock-out pad 109 is fixed by a screw 108 to the bottom end of a knock-out rod 107 which penetrates through the same rotary cylinder 106 in a vertically slidable manner. This knock-out pad 109 is projectable from a recessed portion 110 at the bottom of the above-mentioned chuck 105. In addition, the upper portion of the above-mentioned knock-out rod 107 is inserted via a ball bearing into a knock-out carrier 112. The same knock-out carrier 112 is guided by a knock-out carrier guide 111, and is prevented from rotating by means of an anti-rotation guide pin (not shown) which is parallel to a center axis of the knock-out rod 107. Also, to the knock-out carrier 112 is mounted a cam follower 113, and provision is made such that when the can seamer is operated the cam follower 113 may move up and down following a profile of a 114, cam groove and the movement may be transmitted via the ball bearing to the knock-out rod 107. Parallel twin faces for engagement with a spanner are machined on a shaft 107*a* at the top of the knock-out rod 107.

In order to remove the knock-out pad 109 from the knock-out rod 107 for the purpose of changing the type of knock-out pad as a result of the change of can sizes, the screw 108 is loosened while the top shaft 107*a* of the knock-out rod 107 is held by means of a spanner, the screw 108 is loosened, and thereby the knock-out pad 109 is removed. When a knock-out pad to be replaced is mounted, it is only necessary to perform the above-mentioned steps of operation in the reverse sequence.

As will be seen from the above description, the type-changing work at the time of changing can sizes in the can seamer in the prior art as shown in FIGS. 11 to 13 has a shortcoming in that it necessitates a lot of time and labor because of the fact that a manually operated handle was used for rotating a seaming mechanism, and at the time of replacement of seaming rolls the top end of a seaming roll shaft had to be held by means of a hand tool.

In addition, mounting of a seaming lever and positioning in the vertical direction in the heretofore known can seamer as shown in FIGS. 11 to 13 relied upon the method of aligning a horizontal notch groove cut in a seaming roll shaft with a cam 35 provided on a seaming lever and fixing them by inserting the cam plate into the notch groove. With such a structure, a lot of time is needed to adjust a clearance in the vertical direction of the seaming roll shaft when can sizes are changed. Explaining the reasons, a seaming chuck is spinning at a high speed and also is making rotary movement at a high speed along a circumference as accompanied by seaming rolls, and so if the clearance in the vertical direction of the seaming roll shaft should deviate from a predetermined tolerable value, baking would arise or unacceptable seaming, caused by vibrations would occur. Therefore, in a seaming process between a can and a can lid, the seaming chuck pressing the can lid and the seaming roll for carrying out seaming would necessitate a high precision in positioning. However, in the seaming lever mounting structure in the prior art, clearance adjustment involved problems such as requiring a lot of labor and time because each time the seaming lever must be extracted from the seaming roll shaft to replace or grind a shim.

Also, in the heretofore known apparatus shown in FIG. 14, since there are many seaming chucks mountable on a single seamer, if it is intended to replace the knock-out pad, each time the top end 107 the of a knock-out rod must be restrained by means of a spanner and the knock-out pad 109 must be disengaged by releasing the screw 108, and so there is a problem in that a lot of labor and time were necessitated for mounting and dismounting of the pad.

SUMMARY OF THE INVENTION

It is therefore one object of the present invention to provide a can seamer, in which, at the time of replacement of a seaming roll, positioning of a seaming roll shaft can be achieved automatically, and hence an efficiency of a replacement work for a seaming roll can be improved.

Another object of the present invention is to provide a can seamer in which vertical alignment of a seaming lever and a seaming roll shaft for fitting can be adjusted in a simple manner.

Still another object of the present invention is to provide a can seamer, in which replacement of a knock-out pad can be done in a one-touch operation.

According to one feature of the present invention, there is provided a type-changing apparatus in a can seamer in which a plurality of can seaming mechanisms are disposed at an equal pitch along a circumference that is equidistant from a vertical center axis. The can seaming mechanism is provided with a can table for pushing up a bottom of a can while it is rotating, a seaming chuck for supporting a can lid from the above while rotating at the same speed in the same direction as the aforementioned can table, and a set of two seaming rolls swinging about a seaming roll shaft separate from the above-mentioned seaming chuck provision is made such that during the period when a can covered with a can lid fed at a proper timing by means of a conveyor is being transported along a circumference that is equidistant from the center axis while rotating about a vertical axis, as gripped between the aforementioned can table and the above-described seaming chuck, the top edge of the can and the can lid are seamed by the aforementioned seaming roll and then carried out to the next step of the process. The above-described type-changing apparatus comprises a control mechanism which can arbitrarily drive the same can seaming mechanisms one pitch by one pitch after it has detected a rotational angle of the seaming roll shaft and has stopped the can seaming mechanism at a predetermined position by controlling a drive motor. An actuator mounted on a can seamer main body frame is capable of depressing the top end of the aforementioned seaming roll shaft at one of the can seaming mechanism stop positions.

According to another feature of the present invention, there is provided the above-featured type-changing apparatus in a can seamer, wherein a rotational angle detector for the seaming roll shaft consists of a disc rotating interlocked with rotation of the seaming roll shaft, and an approach sensor for detecting a rotational angle of the same disc.

According to still another feature of the present invention, there is provided the first-featured type-changing apparatus in a can seamer, wherein a rotational angle detector for the seaming roll shaft is a fixed position sensor for detecting the top end of the seaming roll shaft.

According to a further feature of the present invention, there is provided a seaming roll mounting/dismounting mechanism in a can seamer in which a plurality of can seaming mechanisms are disposed at an equal pitch along a circumference that is equidistant from a vertical center axis. The can seaming mechanism is provided with a can table for pushing up a bottom of a can while it is rotating, a seaming chuck for supporting a can lid from the above while rotating at the same speed in the same direction as the aforementioned can table, and a set of two seaming rolls swinging about a seaming roll shaft separate from the above-mentioned seaming chuck. Provision is made such that during the period when a can covered with a can lid fed at a proper timing by means of a conveyor is being transported along a circumference that is equidistant from the center axis while rotating about a vertical axis, as gripped between the aforementioned can table and the above-described seaming chuck, the top edge of the can and the can lid are seamed by the aforementioned seaming roll, and then carried out to the next step of the process. The mounting/dismounting mechanism comprises a seaming roll shaft having a tapered bore drilled towards a center axis of the shaft on a vertical plane portion formed at the lower portion of the shaft, a seaming lever holding the seaming rolls and externally fitting around the lower portion of the aforementioned shaft, a set shaft threadedly engaged with a threaded hole formed in the same lever, a cylindrical adjusting screw provided within a cylindrical space of the same set shaft, and a center pin penetrating through a cylindrical inner space of the same adjusting screw and constructed so as to be freely inserted and extracted. The vertical positioning and fitting between the seaming lever and the seaming roll shaft can be adjusted by the degree of fitting of same center pin into the tapered bore.

According to a still further feature of the present invention, there is provided a knock-out pad mounting-/dismounting mechanism in a can seamer which includes a plurality of seaming mechanisms making rotational movement along a horizontal circumference and which perform seaming while making rotational movement. The aforementioned can seamer includes a knock-out rod, a knock-out pad that is detachably mounted to the same knock-out rod, and a braking mechanism for stopping rotation of the knock-out rod. At the bottom end of the same knock-out rod are formed an anti-rotational protrusion for the knock-out pad, a bore for inserting a headed shaft provided in the knock-out pad, and a step portion capable of supporting a pin provided on the headed shaft. On the other hand, in the knock-out pad are formed a headed shaft mounted in a vertically slidable manner, and a grooved portion for engaging with the pin mounted to the same headed shaft and the above-mentioned protrusion of the knock-out rod. By inserting the headed shaft of the above-mentioned knock-out pad into the bore of the knock-out rod and rotating the shaft, the pin mounted to the shaft is supported by the step portion formed in the knock-out rod, and both members can be assembled.

In the can seamer according to the above-mentioned first feature of the present invention, at the time of type-changing work upon can size change, as a measure for rotating the seaming mechanisms, when the respective can seaming mechanisms have come to predetermined positions on the frame of the can seamer main body, a drive motor for the can seamer is stopped Thereby the seaming mechanisms are stopped by means of a control apparatus formed by combining a detector for detecting a rotational angular position of a rotary center axis (vertical axis), the drive motor of the can seamer and a manually operated switch for the same motor. Thereafter, if the above-mentioned manually operated switch is pressed, the seaming mechanisms would move by a distance corresponding to one pitch, and would stop again. In addition, at the predetermined positions on the frame of the aforementioned can seamer main body are mounted actuators which would act to press the top end of the seaming roll shaft of the stopped seaming mechanisms and thereby facilitate the replacement work of the seaming rolls.

In the can seamer according to the above-mentioned fourth feature of the present invention, at the bottom portion of the seaming roll shaft is formed a plane portion by grinding flat several splines (serrations) around which the seaming lever is externally fitted, and also a tapered bore is drilled at right angles to this plane. On the other hand, a threaded hole is formed in the seaming lever, and a set shaft containing therein a center pin having an adjustable projection length and having its tip end tapered similarly to the above-mentioned tapered bore is threadedly engaged with the threaded hole. After the seaming lever has been fitted to the splines at the bottom of the seaming roll shaft, if this set shaft is screwed in to press the plane portion of the above-mentioned seaming roll shaft, then the seaming lever can be fixed to the seaming roll shaft. In addition, as the diameter of the center pin is made smaller than the inner diameter of the tapered bore, if the center pin is inserted or extracted with the taper on the underside of the center pin aligned with the underside of the tapered bore, the vertical positional fitting between the seaming lever and the seaming roll shaft can be adjusted. In other words, the clearances above and under the seaming roll shaft can be adjusted by positional adjustment of this seaming lever. Also, since the center pin is pressed by a compression spring contained in the center pin projection length adjusting screw within the above-mentioned set shaft, the seaming lever can be dismounted in a simple manner by extracting the center pin from the tapered bore in the seaming roll shaft by externally pulling the center pin.

In the can seamer according to the above-mentioned fifth feature of the present invention, a stepped through-hole is drilled in the shaft portion of the knock-out pad. A short cylindrical portion for centering and a horizontal groove for preventing rotation are provided at the top of the shaft position. A compression spring is inserted in the stepped through-hole, and a headed shaft machined with a minus groove or a cross groove for engaging with a driver is pushed into the stepped through-hole of the knock-out pad so as to place the compression spring therebetween to be biased by the compression spring. A pin is inserted into a lateral hole in the projected headed shaft to retain the same. At the bottom of the knock-out rod is drilled a cylindrical bore concentric with the rod. A ring-shaped groove is formed at a deep portion of the bore, two vertical grooves are machined symmetrically in parallel to the center line of the bore from the entrance of the cylindrical bore up to the ring-shaped groove, on the lower surface of the ring-shaped groove is formed a semicircular groove at a position at right angles to the positions of the aforementioned vertical grooves, and at the bottom surface of the knock-out rod are formed a step for centering with the knock-out pad and an anti-rotational horizontal protrusion. The top end of the shaft of the knock-out pad is joined with the bottom end of the knock-out rod, the headed shaft contained in the knock-out pad is pushed into the knock-out rod so that the pin mounted at the tip of the shaft may be guided along the vertical grooves of the knock-out rod, and when the above-mentioned pin has reached the ring-shaped groove in the knock-out rod, if the headed shaft is rotated by 90° and the headed shaft is released at the position where the pin has aligned with the semi-circular groove of the ring-shaped groove, then mounting of the knock-out pad is finished.

In order to prevent the knock-out rod from rotating at the time of replacement of the knock-out pad, a disc is mounted to the top of the knock-out rod. An actuator, such as a pneumatic actuator or the like, acting downwards, is mounted to the frame of the seamer main body at an appropriate position on the circumference depicted by a point on an upper extension of the center axis of the knock-out rod, and a braking pad is mounted to the tip end of the action rod of the actuator. Upon replacement of a knock-out pad, the seamer is operated in such manner that a turret having the seaming mechanisms mounted thereon may be rotated one pitch, by one pitch and knock-out rods may successively come right under the actuator and then may stop. When the seamer has stopped, the actuator is operated to press the disc at the top of the knock-out rod with the pad mounted at the tip of the action rod to brake the disc, and the knock-out pad is removed by turning the headed shaft from the underside of the knock-out pad by means of a driver. Subsequently, while the knock-out rod is kept braked by the actuator, a new knock-out pad to be replaced is inserted into the knock-out rod and turned, and thereby replacement is completed.

According to the first to third aspects of the present invention, in a type-changing work of a can seamer, since a seaming roll shaft can be automatically constrained by means of an actuator, remarkable advantages as compared to the can seamer in the prior art, in which the seamer was rotated by a manually operated handle and the seaming roll shaft was constrained by means of a hand tool can be achieved, e.g. labor and time can be greatly reduced.

According to the fourth aspect of the present invention, in a type-changing work of a can seamer, since setting of a gap clearance in the vertical direction of a seaming roll shaft can be achieved easily by merely adjusting a fitting condition between a tapered bore formed in a seaming roll shaft and a center pin provided in a seaming lever, even in the case where dimensions are varied delicately due to temperature variations, remarkable advantages are obtained in labor and time necessitated for adjustment of the gap clearance can be saved.

According to the fifth aspect of the present invention, since replacement of a knock-out pad accompanying change of can sizes can be carried out by a one-touch operation in a can seamer, remarkable advantages are achieved in that it is possible to spare labor and time even in a multiple can seamer.

BRIEF DESCRIPTION OF THE DRAWINGS

The above-mentioned and other objects, features and advantages of the present invention will become more apparent by reference to the following description of preferred embodiments of the invention taken in conjunction with the accompanying drawings, in which.

DESCRIPTION OF THE PREFERRED EMBODIMENTS

Figure 1:
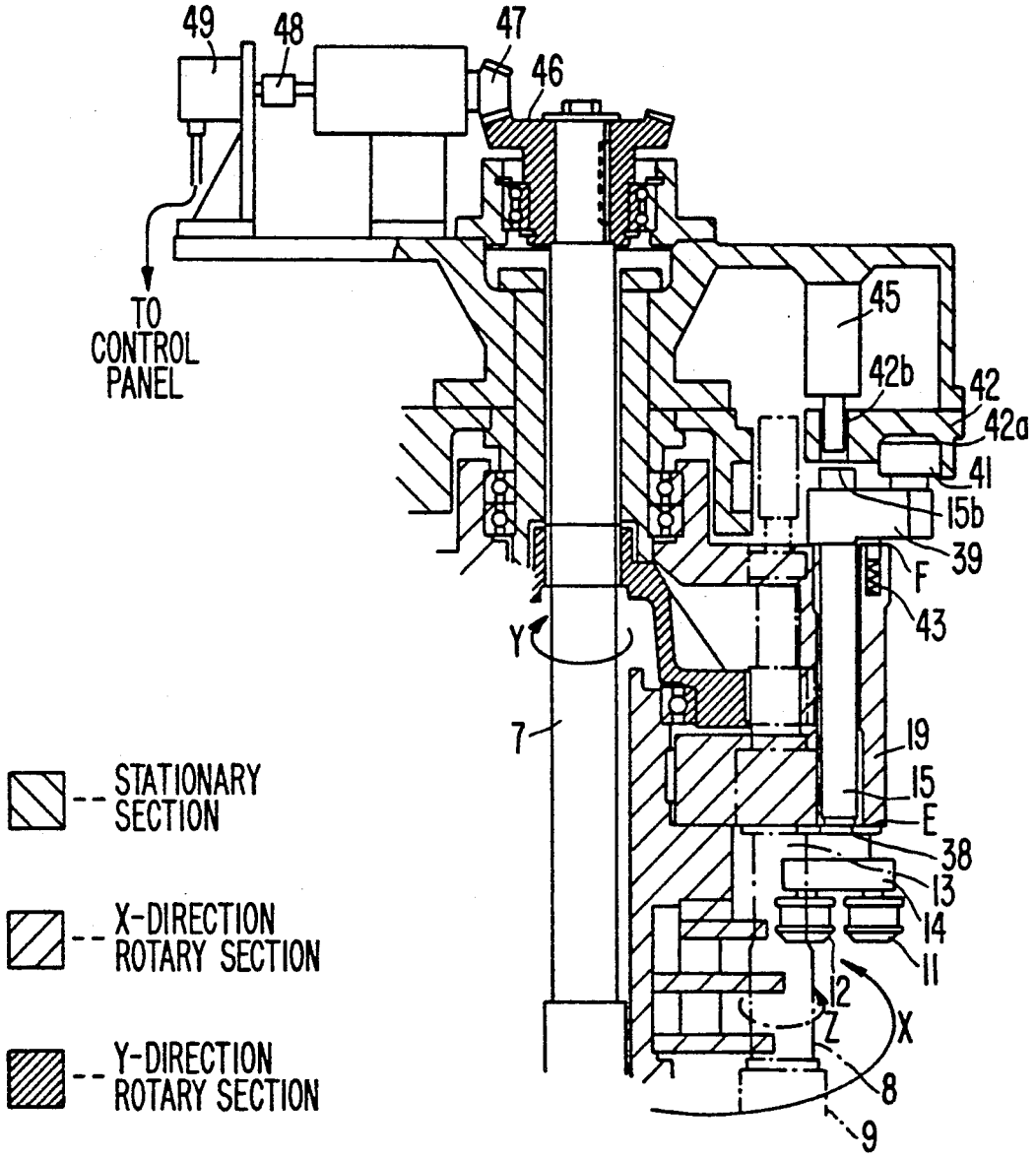
FIG. 1 is a cross-sectional view, partly cut away, of a can seamer according to a first preferred embodiment of the present invention.
Figure 2:
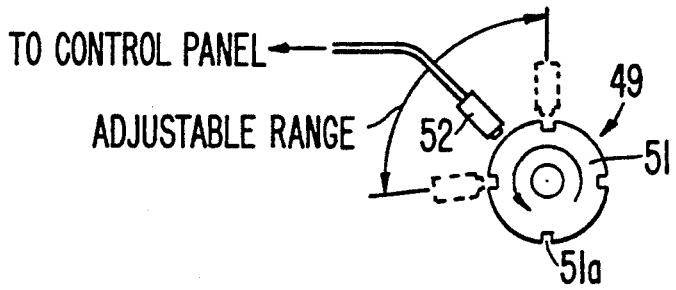
FIG. 2 is the schematic view showing a structure of a rotational position sensor in the first preferred embodiment of the present invention.
Figure 3:
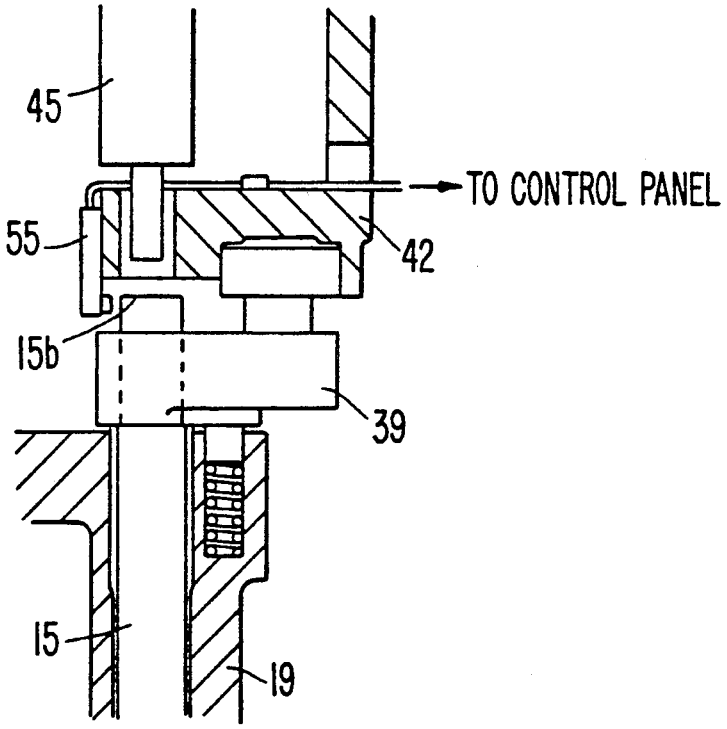
FIG. 3 is a vertical cross-sectional view of a position sensor mounting portion in the first preferred embodiment of the present invention.
Figure 4:
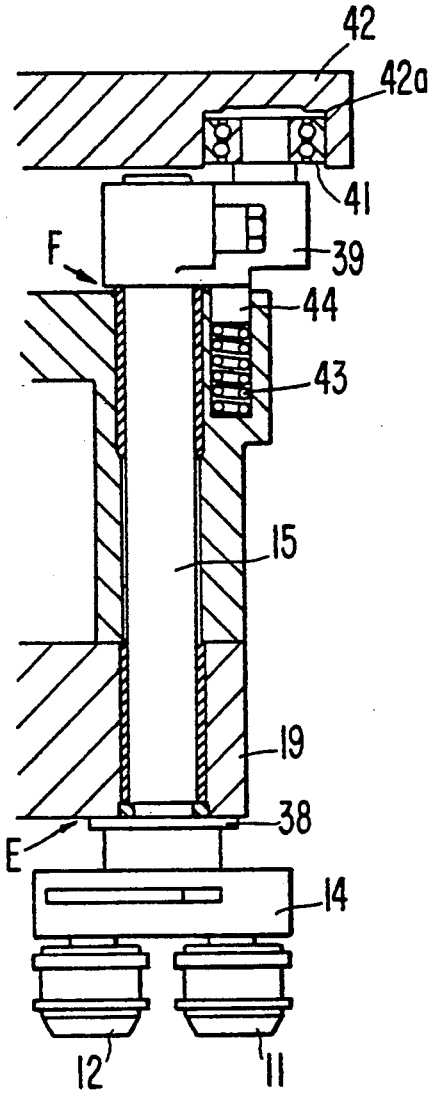
FIG. 4 is a vertical cross-sectional view of the proximity of a seaming roll shaft in the first preferred embodiment of the present invention.
Figure 11:
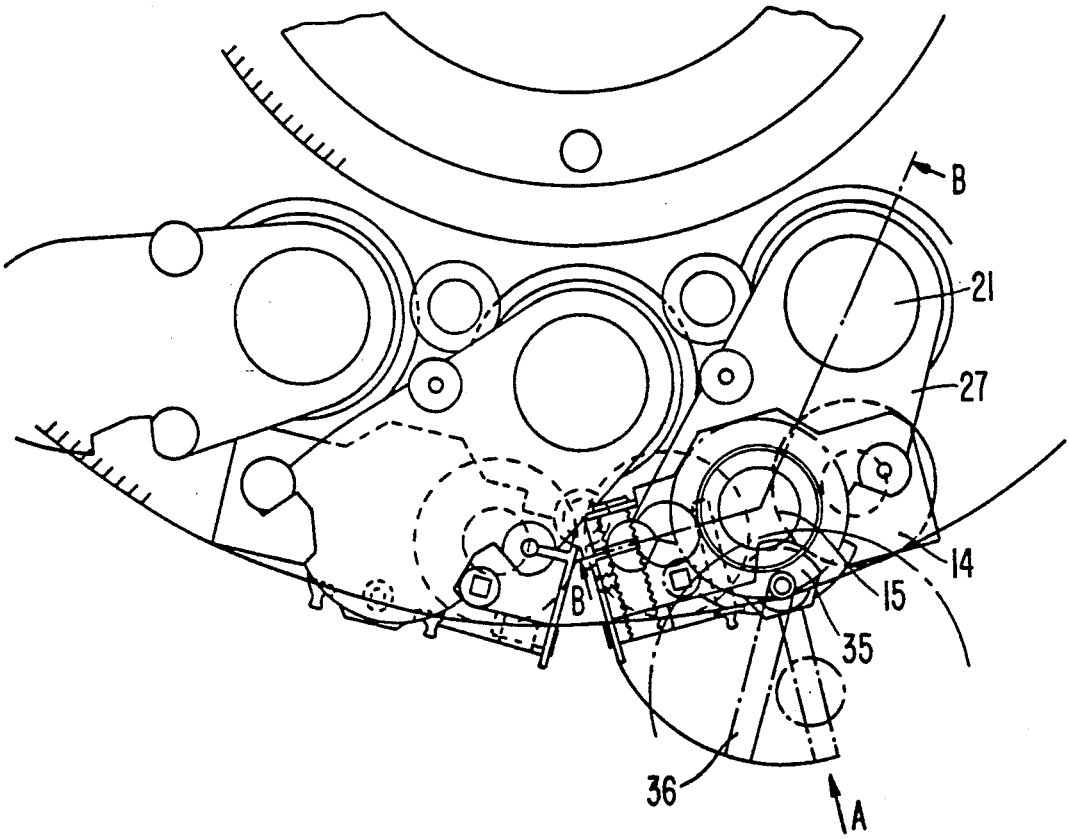
FIG. 11 (PRIOR ART)
FIG. 11 is a plan view of a seaming mechanism in a can seamer in the prior art.
Figure 12:
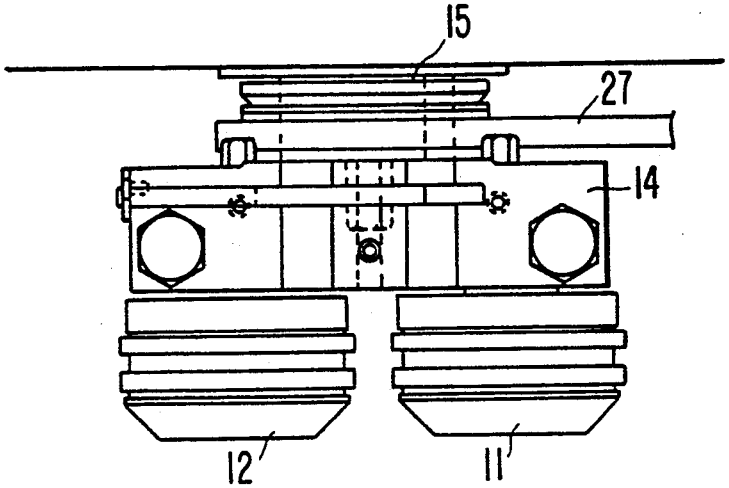
FIG. 12 (PRIOR ART)
FIG. 12 is a side view of seaming rolls and relevant members in a can seamer in the prior art.
Figure 13:
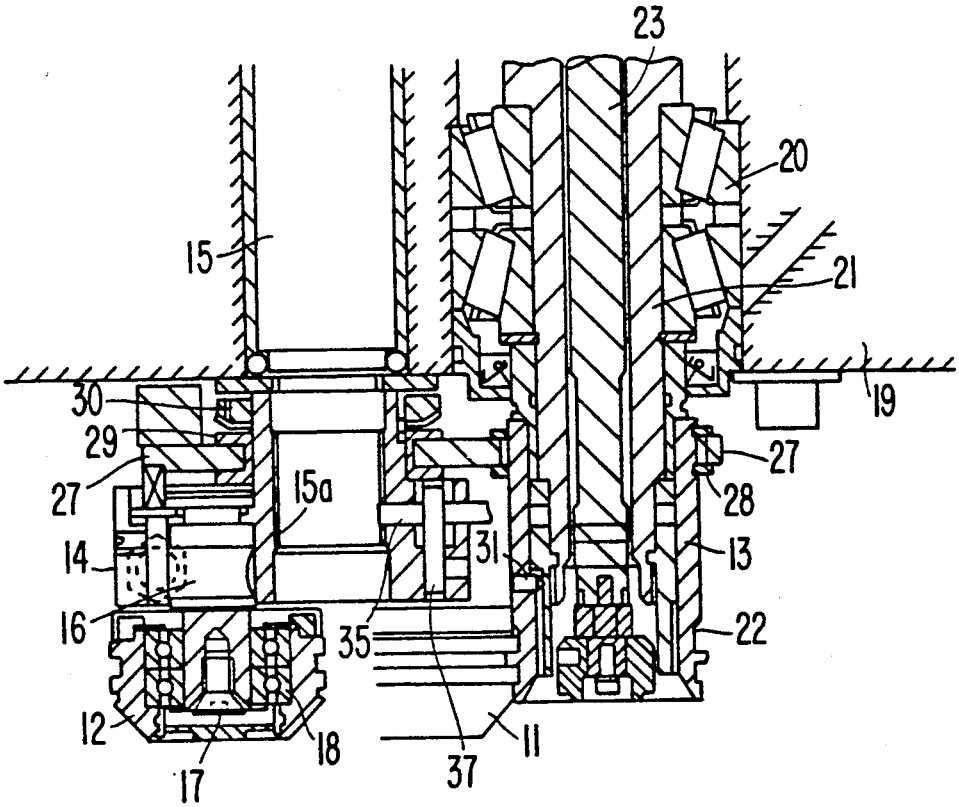
FIG. 13 (PRIOR ART)
FIG. 13 is a vertical cross-section view of a seaming mechanism in a can seamer in the prior art.
Figure 14:
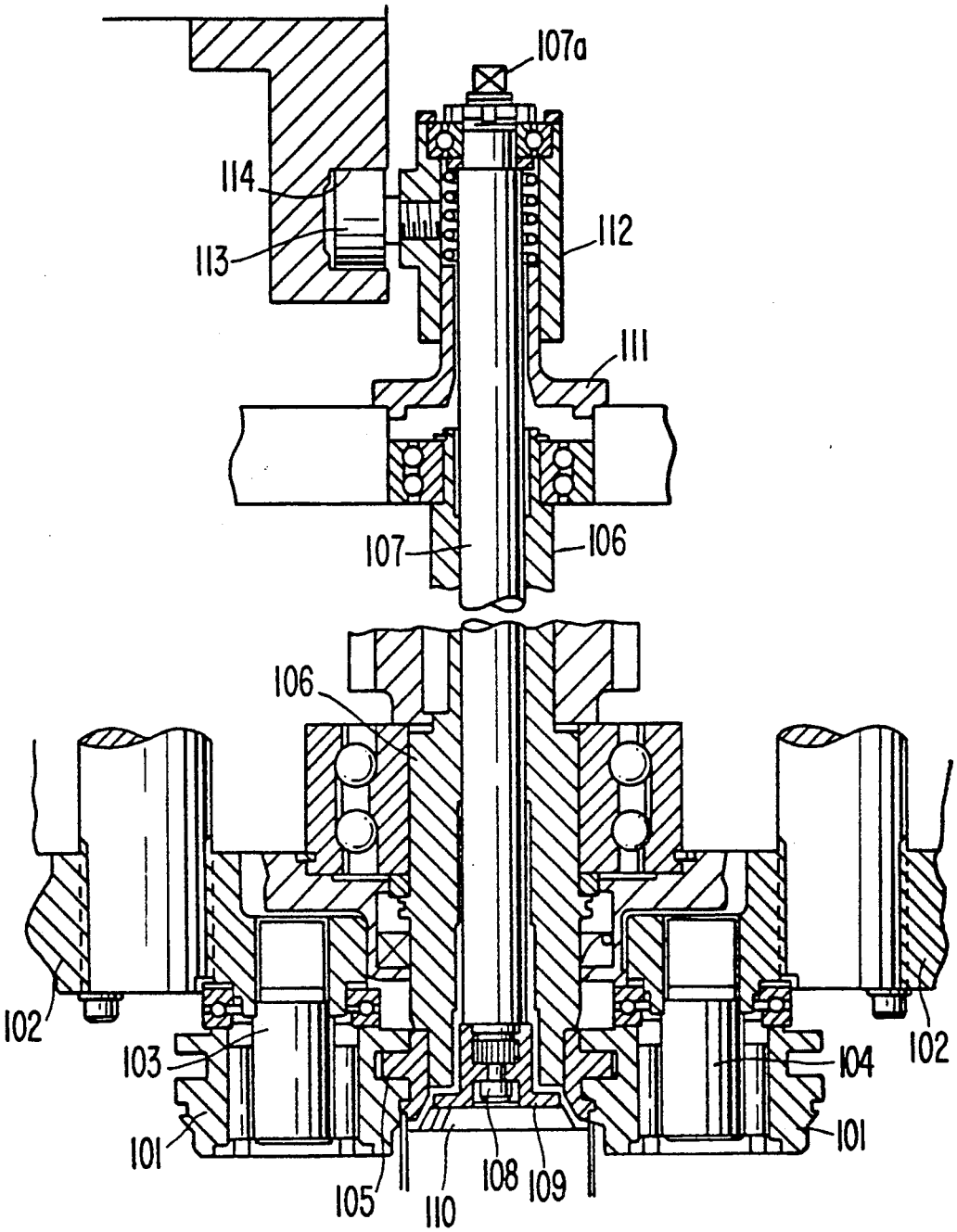
FIG. 14 (PRIOR ART)
FIG. 14 is a vertical cross-section view of a knock-out pad apparatus in a can seamer in the prior art.

In the following, the preferred embodiments of the present invention will be described in detail with reference to the accompanying drawings. FIG. 1 is a vertical cross-sectional view of the entire seaming mechanism in a rotary type can seamer according to a first preferred embodiment of the present invention, and FIGS. 2 to 4 are schematic views showing essential parts of the same mechanism. With regard to a seaming mechanism in a conventional can seamer, description was already made with reference to FIGS. 11 to 13, which illustrate the prior art, and since the seaming mechanism is not different from that in the prior art, in this first preferred embodiment shown in FIG. 1 also, further explanation thereof will be omitted, and description will be made only on the point different from the can seamer in the prior art shown in FIGS. 11 to 13.

In FIGS. 1 to 4, reference numeral 7 designates a vertical center shaft of a can seamer. A rotary frame 19 integrated with a cylindrical shaft concentric with the center shaft 7 is fitted around the center shaft 7 so as to be freely rotatable about the vertical center shaft 7, and is adapted to rotate in the direction of arrow X, on the rotary frame 19 are disposed a plurality of seaming mechanisms at an equal pitch along a concentric circumference. Also, the vertical center shaft 7 rotates in the opposite direction to the rotary frame 19, that is, in the direction of arrow Y, to rotate a seaming chuck 13 on the rotary frame 19 as well as a can table 9 and a can 8 at a high speed in the direction of arrow Z. A main body frame 42 is a stationary frame, and in this frame 42 are provided a cam groove **42*a* and a through-hole 42*b*. In addition, to the main body frame 42 is mounted a pneumatic actuator 45. An action rod of the actuator 45 penetrates through the above-mentioned through-hole 42*b*, and also, a rotational position sensor 49 is mounted to the left upper portion (as viewed in FIG. 1) of the main body frame 42. Rotation of the vertical center shaft 7 is transmitted from a bevel gear 46 mounted to the top end of the same center shaft to a smaller bevel gear 47, and is transmitted from the shaft of the smaller bevel gear 47 via a direct-coupling 48 to the above-mentioned rotary position sensor 49**.

In FIG. 2 is shown a structure of a rotational position sensor 49, in which a disc 51 is provided so that the disc 51 may be rotated by the rotational motion transmitted from the smaller bevel gear 47. On the disc 51 are formed grooves 51*a* or protrusions along its outer circumference at an equal pitch, and provision is made such that the grooves 51*a* or protrusions of the above-mentioned disc 51 can be detected by means of an approach sensor 52, whose angular mounting position can be adjusted along the outer circumference of the disc 51.

If the can seamer is designed to be a 12-unit assembly (having 12 sets of can seaming mechanisms), a rotational speed of the rotary frame 19 and a rotational speed of the vertical center shaft 7 are the same, and a gear ratio of the bevel gear 46 to the smaller bevel gear 47 is 3:1, then the grooves 51*a* or the protrusions of the above-mentioned disc 51 can be matched to the pitch of the can seaming mechanism by providing four such grooves or protrusions at an equal pitch along the circumference. Alternatively, in place of the above-mentioned rotational position sensor 49, even with the structure of a position sensor 55 shown in FIG. 3, the same operational effect can be obtained. More particularly, the position sensor 55 is mounted in the proximity of the through-hole 42*b* of the stationary main body frame 42, and it can directly detect the top end 15*b* of the seaming roll shaft 15.

Now, mounting and dismounting works of the seaming lever to and from the seaming roll shaft will be explained. If a control mode of a drive motor not shown) is switched to a type-changing mode, each time an action button is depressed, the drive motor moves the can seaming mechanism one pitch, and stops it at a predetermined position. At the stopped position, if the top end 15*b* of the seaming roll shaft 15 is depressed by actuating the action rod of the pneumatic actuator 45, then a gap clearance is formed between the rotary frame 19 and a seaming lever 14, and hence the force pushing the seaming lever 14 in the vertical direction is released. A cam 35 (See FIGS. 11 and 13) retaining the seaming lever 14 on the seaming roll shaft 15 can be easily disengaged, and by loosening a bolt 31, the seaming lever 14 can be easily extracted from the seaming roll shaft 15 jointly with the seaming rolls 11 and 12. Also, the seaming chuck 13 integrally connected to the seaming lever 14 by the connecting bracket 27 can be easily extracted from a rotary cylinder 21. Subsequently, a new seaming chuck is inserted on splines 22 and fixed by means of the bolt 31, and a new seaming lever is fitted around the seaming roll shaft 15 and fixed by means of the cam 35. Next, the action rod of the pneumatic actuator 45 is pulled up, and by depressing the action button, the next type-changing work is commenced. When employing the position sensor 55 of FIG. 3, the operation is quite identical.

Figure 5:
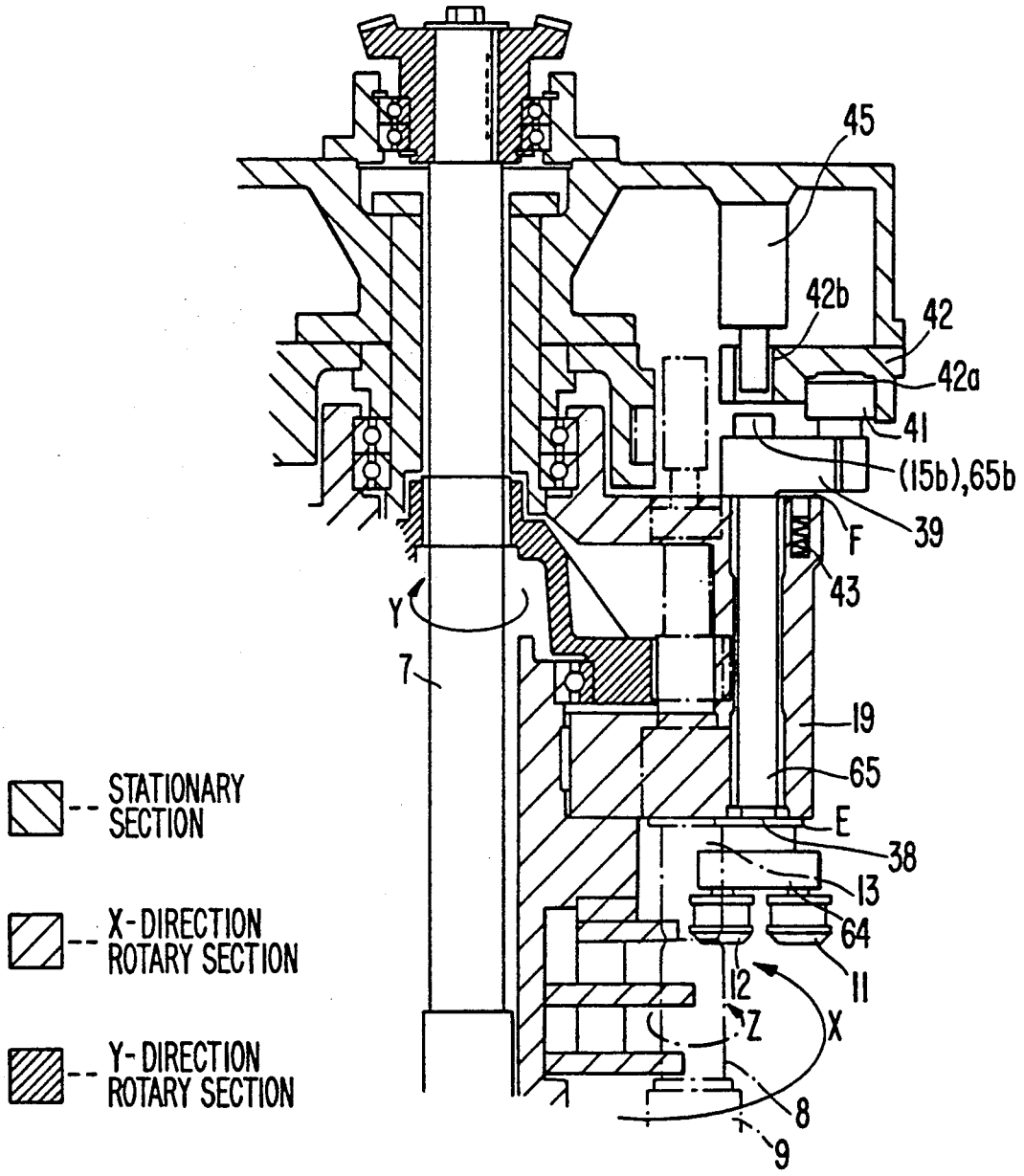
FIG. 5 is a vertical cross-sectional view of a seaming mechanism in a can seamer according to a second preferred embodiment of the present invention.
Figure 6:
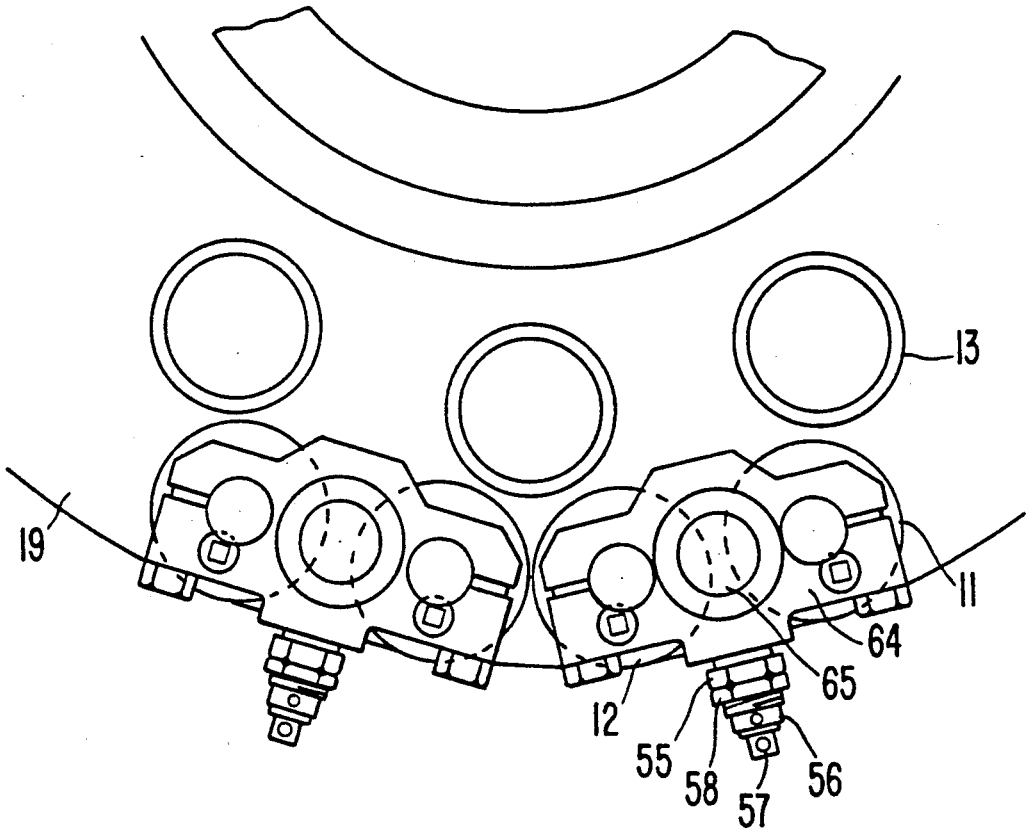
FIG. 6 is a plan view of seaming rolls and relevant members in the second preferred embodiment of the present invention.
Figure 7:
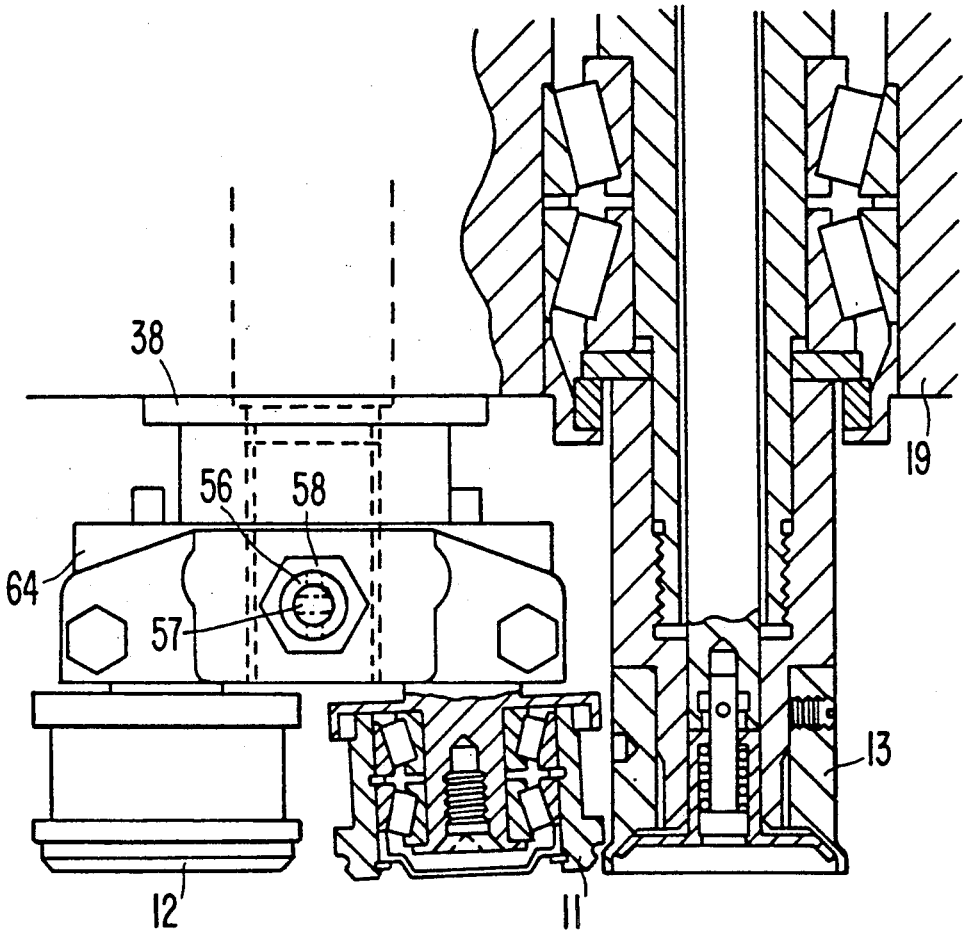
FIG. 7 is a side view partly in cross-section, of a seaming mechanism in the second preferred embodiment of the present invention.
Figure 8:
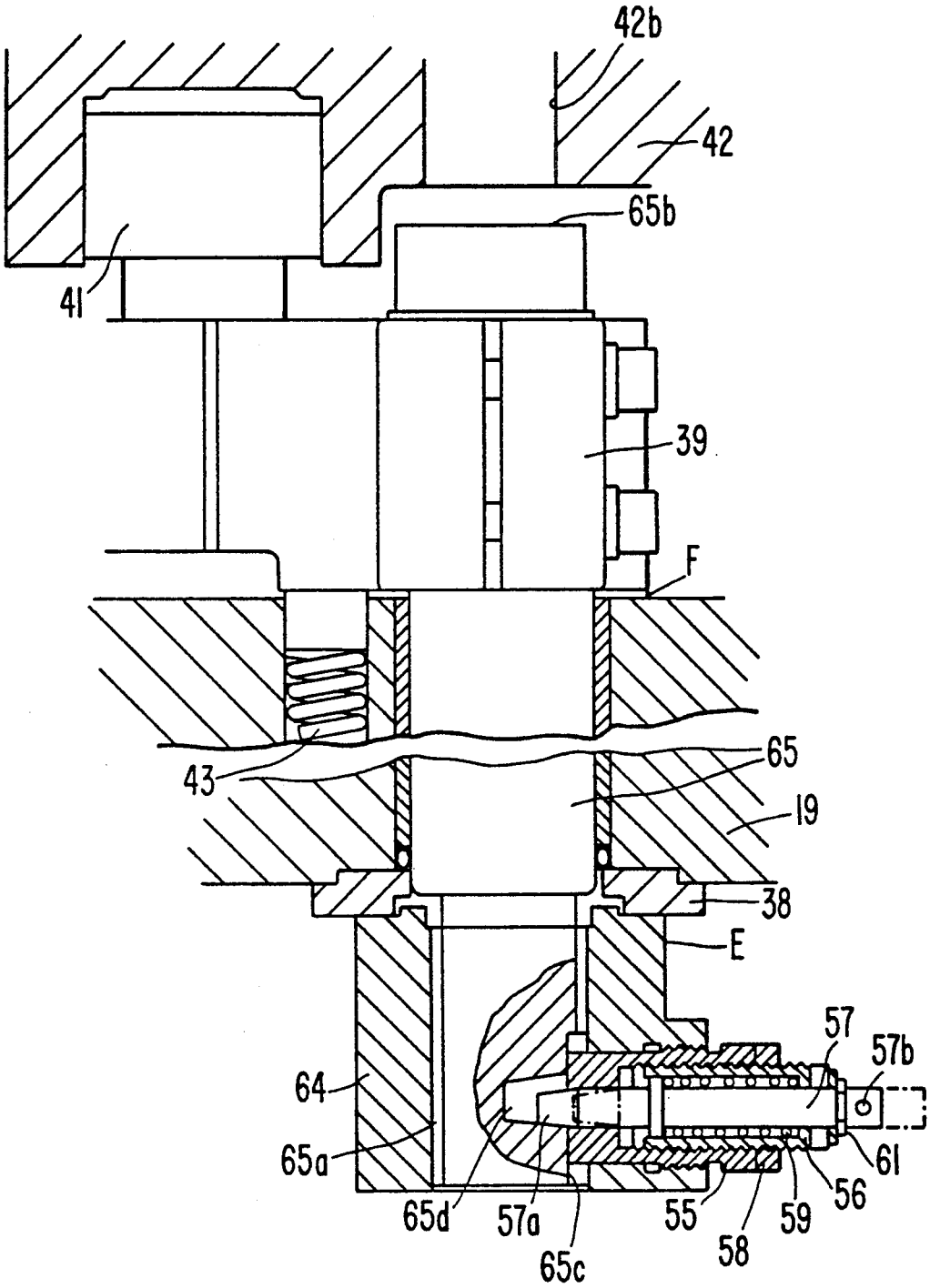
FIG. 8 is a cross-sectional view of a seaming lever and relevant members in the second preferred embodiment of the present invention.

In the following, a second preferred embodiment of the present invention will be described with reference to FIGS. 5 to 8. FIG. 5 is a vertical cross-sectional view of the entire seaming mechanism in a rotary type can seamer according to the second preferred embodiment of the present invention, and FIGS. 6 to 8 are schematic views showing essential parts of the same mechanism. With regard to a conventional can seamer, description was already made with reference to FIGS. 11 to 13, which illustrate the prior art, and since the seaming mechanism is not different from that in the prior art, in this second preferred embodiment also, the seaming mechanism is illustrated by giving like reference numerals, but further explanation thereof is omitted, and description will be made only on the points different from the can seamer in the prior art shown in FIGS. 11 to 13.

In FIG. 5, reference numeral 7 designates a vertical center shaft of a can seamer. A rotary frame 19 integrated with a cylindrical shaft concentric with the center shaft 7 is fitted around the vertical center shaft 7 so as to be freely rotatable about the vertical center shaft 7, and is adapted to rotate in the direction of arrow X, and on the same rotary frame 19 are disposed a plurality of seaming mechanisms at an equal pitch along a concentric circumference. Also, the vertical center shaft 7 rotates in the opposite direction to the rotary frame 19, that is, in the direction of arrow Y, to rotate a seaming chuck 13 on the rotary frame 19 as well as a can table 9 and a can 8 at a high speed in the direction of arrow Z. To the rotary frame 19 is rotatably mounted a seaming roll shaft 65, and a seaming lever 64 is externally fitted around splines 65*a* (FIG. 8) in the lower portion of the same shaft 65. The splines 65*a* are provided with a plane 65*c* formed by scraping several of the splines the plane 65*c* and being parallel to its axis. At the center of the plane 65*c* is drilled a tapered bore 65*d* in the direction nearly at right angles to the plane 65*c* so that the plane 65*c* can be fixed by pushing it with a tip end of a set shaft 55 threadedly engaged with the seaming lever 64. The above-mentioned set shaft 55 contains therein a center pin 57 having a tapered shaft portion 57*a* whose projection length can be adjusted. By adjusting the projection length of this tapered shaft portion 57*a*, an abutting position against the tapered bore 65*d* can be varied so that fine adjustment of the vertical position of the seaming lever 64 can be achieved.

Now, details of the structure of the set shaft 55 for fixing the seaming lever 64 to the seaming roll shaft 65, and its proximity, will be explained with reference to FIG. 8. The set shaft 55 is threadedly engaged with a threaded hole in the seaming lever 64, and also it is guided with a precise fitting tolerance by an axial hole concentric with the threaded hole. Also, on the inside of the set shaft 55 are formed threads. An adjusting screw 56 is threadedly engaged with these threads, and a lock nut 58 is threadedly engaged with the same adjusting screw 56. The adjusting screw 56 has a stepped hollow shape into which a center pin 57 is inserted, and a compression spring 59 is disposed between a flange portion of the center pin 57 and the step of the adjusting screw 56. The center pin 57 is prevented from slipping out from the adjusting screw 56 by means of a retaining ring 61. Furthermore a lateral hole 57*b* is drilled in its projected shaft portion. The shaft portion of the center pin 57 penetrates through the hole in the set shaft 55 to be guided with a precise fitting tolerance, and the tip end of the same pin 57 is formed into a tapered shaft portion 57*a* of the same angle as the tapered bore 65*d* in the seaming roll shaft 65. A main body frame 42 is a stationary frame, and as shown in FIG. 5, the frame 42 is provided with a cam groove 42*a* and a through-hole 42*b*. In addition, a pneumatic actuator 45 is mounted to the main body frame 42, and an action rod of the same actuator 45 is adapted to pass through the above-mentioned through-hole 42*b*.

Next, mounting and dismounting work of the seaming lever to and from the seaming roll shaft will be explained. The can seaming mechanism in the can seamer is moved one pitch by one pitch by means of a manually operated handle or by the momentary driving of a motor, and it is stopped at a predetermined position. At the stopped position, if the top end 65*b* of the seaming roll shaft 65 is depressed by actuating an action rod of the pneumatic actuator 45, then a cam lever 39 and the rotary frame 19 would come into tight contact, and a gap clearance F would become zero, while a gap clearance E is produced between a washer 38 mounted to the rotary frame 19 and the seaming lever 64, and the force pushing the seaming lever 64 in the vertical direction is released. The contact pressure between the set shaft 55 and the plane 65*c* of the seaming roll shaft 65 is released by turning the set shaft 55, and the center pin 57 is extracted to disengage the tapered shaft portion 57*a* from the tapered bore 64*d* in the seaming roll shaft 65. Then the seaming lever 64 can be easily dismounted from the spline 65*a* of the seaming roll shaft 65.

When a new seaming lever 64 to be replaced is mounted to the seaming roll shaft 65, the set shaft 55 threadedly engaged with the same lever 64 is preliminarily screwed back a little, the center pin 57 is preliminarily pulled out from the set shaft 55 by inserting a hand tool into the hole 57*b* of the center pin 57, and then the seaming lever 64 to be replaced is fitted into the spline 65*a* of the seaming roll shaft 65. While the seaming lever 64 is kept pressed from the bottom, the center pin 57 is released to insert its tapered shaft portion 57*a* into the tapered bore 64*d* in the seaming roll shaft 65, and then the gap clearance E is measured. When the gap clearance E has a proper value, the seaming lever 64 is fixed at that position by turning the set shaft 55. When the gap clearance E does not have a proper value, the lock nut 58 for the adjusting screw 56 is loosened, then the center pin 57 is moved back or forth by turning the adjusting screw 56, and thus after the gap clearance E has been made to have a proper value by finely adjusting the vertical position of the seaming lever 64, the seaming lever 64 is fixed by turning the set shaft 55. Thereafter, the action rod of the pneumatic actuator 45 is pulled up, the can seaming mechanism is moved by one pitch by means of a manually operated handle or by a motor driving in response to momentary actuation, and the next type-changing work is commenced.

Figure 9:
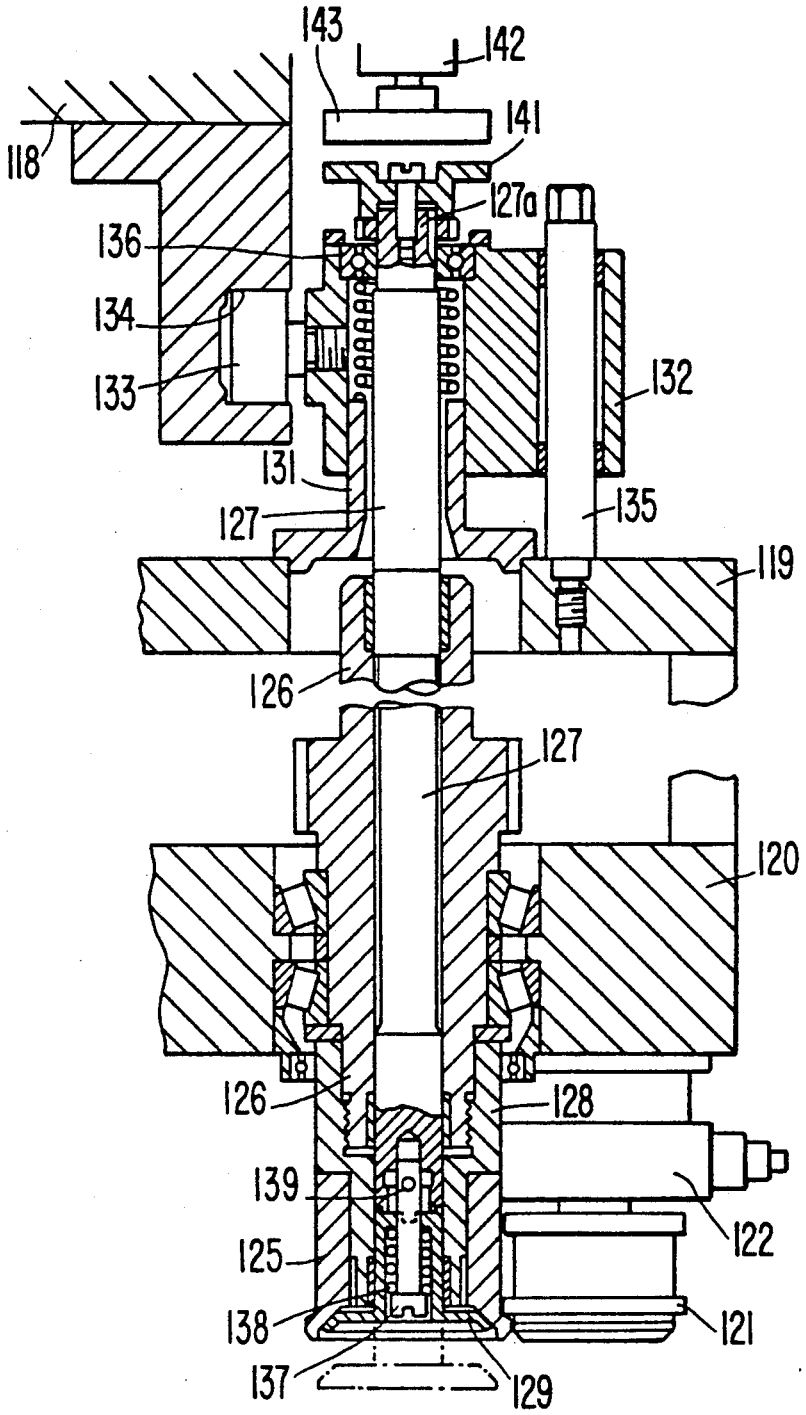
FIG. 9 is a vertical cross-sectional view of a knock-out pad apparatus in a can seamer according to a third preferred embodiment of the present invention.
Figure 10:
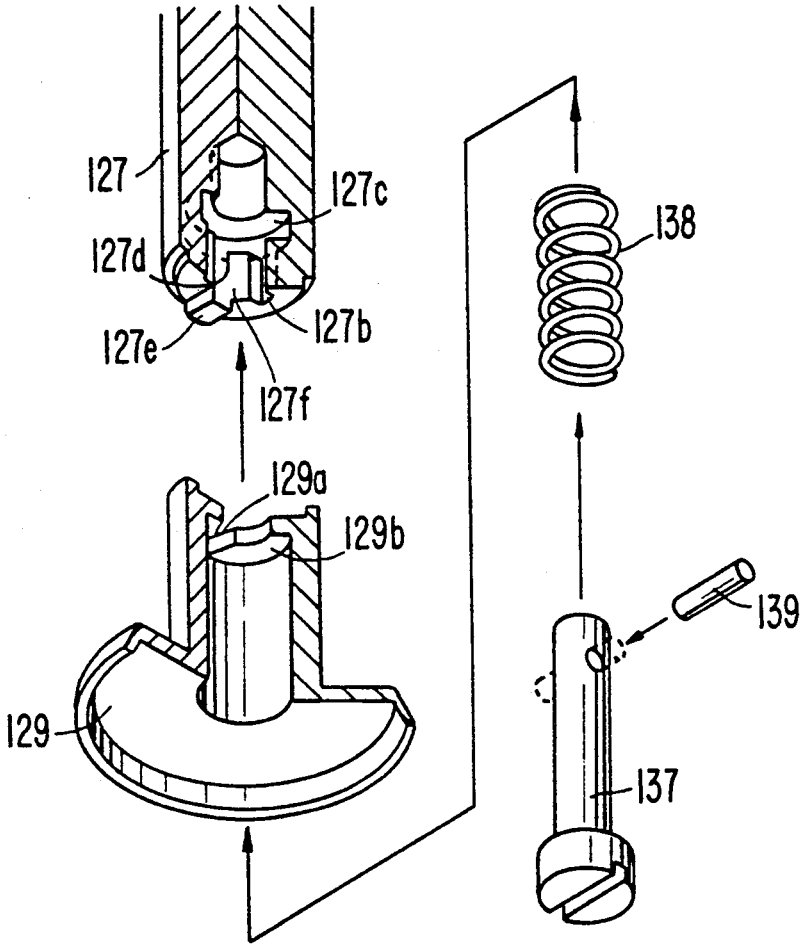
FIG. 10 is an exploded perspective view of knock-out pad parts in the third preferred embodiment of the present invention.

In the following, description will be made of a third preferred embodiment of the present invention with reference to FIGS. 9 and 10. FIG. 9 is a vertical cross-section of a seaming pad and a seaming rod, and FIG. 10 is an exploded perspective view of a knock-out pad portion. In FIG. 10, reference numeral 121 designates a seaming roll, which is rotatably mounted to a shaft fixed to a seaming lever 122. Reference numeral 125 designates a seaming chuck, which is fixed to the bottom end of a joint cylinder 128 mounted to a rotary cylinder 126 by means of serrations and a setscrew. The rotary cylinder 126 is rotatably mounted to a lower turret frame 120 via a roller bearing. At the bottom end of a knock-out rod 127, penetrating through the same rotary cylinder 126 and the joint cylinder 128 in a vertically slidable manner, is detachably fixed a knock-out pad 129 by means of a headed shaft 137, a compression spring 138 and a pin 139 in a manner described later. The knock-out pad 129 can be projected from a recessed portion at the bottom of the above-mentioned seaming chuck 125 by lowering the knock-out rod 127.

The top portion of the above-mentioned knock-out rod 127 is inserted into a knock-out carrier 132 via a ball bearing 136. The knock-out carrier 132 is guided by a knock-out carrier guide 131, and is inhibited from rotation by an anti-rotational guide pin 135 vertically fixed to an upper turret frame 119. Also, a cam follower 133 is mounted to the knock-out carrier 132. When the seamer is operated, the knock-out carrier 132 would move up and down following a profile of a cam groove 134 fixed to a main body frame 118. The movement is transmitted to the knock-out rod 127 via the ball bearing 136. A disc 141 is mounted by a screw to a shaft 127*a* at the top of the knock-out rod 127. Reference numeral 142 designates a pneumatic actuator mounted to the main body frame 118 that is directed downwards, and at the tip end of an action rod of the actuator 142 is mounted a braking disc-shaped pad 143. If the actuator 142 is operated and the braking disc-shaped pad 143 is lowered to make it butt against the disc 141, then rotation of the knock-out rod 127 can be stopped and constrained. This is for the purpose of preventing the rod 127 from rotating when the knock-out pad 129 is replaced.

Now, description will be made of an engaging structure between the knock-out rod 127 and the knock-out pad 129 with reference to FIG. 10. At the bottom of the knock-out rod 127 is formed a cylindrical bore 127*f*, and along the same cylindrical bore 127*f* are symmetrically formed two vertical grooves 127*b*, which reach a ring-shaped groove 127*c*. These two vertical grooves 127*b* are provided for allowing a pin 139 mounted to the headed shaft 137, which will be described later, to pass therethrough. In addition, at a position not interfering with the above-mentioned vertical grooves 127*b* on the surface of the underside of the ring-shaped groove 127*c*, a through-hole is drilled in the knock-out rod 127 so that a horizontal semi-circular groove 127*d* may be formed. It is to be noted that the semi-circular groove 127*d* is provided for the purpose of supporting the pin 139 mounted to the headed shaft 137. On the lower surface of the knock-out rod 127 is provided an anti-rotational protrusion 127*e*.

In addition, at the axial end of the above-mentioned knock-out rod 127 is provided a concentric circular step for the purpose of centering with the knock-out pad 129. A step 129*b* is formed in the hollow shaft of the knock-out pad 129, and on the axial upper surface is provided a faucet joint portion, and this faucet joint portion engaging with the step on the end surface of the knock-out rod. Also, at the step 129*b* is formed a groove 129*a* which meshes with the protrusion 127*e* of the knock-out rod 127 to serve as an anti-rotational member. On the other hand, in order to mount the knock-out pad 129 to the knock-out rod 127, as shown in FIG. 10, a headed shaft 137, a compression spring 138 and a pin 139 are prepared, and when the knock-out pad 129 is to be mounted to the knock-out rod 127, as shown by arrows, the compression spring 138 is inserted into the bore of the knock-out pad 129, thereafter the shaft of the headed shaft 137 is inserted into the compression spring 138, the headed shaft 137 is made to project from the hole of the step 129*b* by forcibly compressing the compression spring 138, and the pin 139 is inserted. In this way, the headed shaft 137, the compression spring 138 and the pin 139 are mounted to the knock-out pad 129.

Subsequently, the faucet joint portion of the knock-out pad and the step portion of the knock-out rod 127 are joined. The groove 129*a* and the protrusion 127*e* are joined, the headed shaft 137 is inserted into the bore 127*f* of the knock-out rod 127, the pin 139 is inserted into the vertical grooves 127*b*, to a position where the pin 139 has been sufficiently pushed in and has reached the ring-shaped groove 127*c*, the headed shaft 137 is turned with a hand tool, and the pin 139 is inserted into the semi-circular groove 127*d*. Thus, the work of mounting the knock-out pad 129 to the knock-out rod 127, is completed.

Next, a replacement work for the knock-out pad 129 will be described. At first, while the can seamer is being operated, when the knock-out rod 127 has come right under the pneumatic actuator, the can seamer is stopped, and the braking disc-shaped pad 143 is lowered by actuating the actuator 142. By this operation, the disc 141 mounted to the top end 127*a* of the knock-out rod 127 is pressed by the braking disc-shaped pad 143, and so, the knock-out rod 127 is braked. Subsequently, under the condition where the knock-out rod 127 is constrained not to rotate by the brake, if the pin 39 is aligned with the vertical grooves 127*b* by turning the headed shaft 137 with a hand tool, the headed shaft 137 is moved downwards by the biasing force of the compression spring 138, and the knock-out pad 129 is disengaged from the knock-out rod 127. Then, by mounting a necessary knock-out pad to the knock-out rod 127 through a procedure that is reverse to the above-mentioned procedure, replacement of the knock-out pad 129 is effected.

As will be apparent from the detailed description of the preferred embodiments of the present invention above, according to the first to third aspects of the present invention, owing to the fact that a seaming roll shaft can be automatically constrained by means of a pneumatic actuator, there is provided a remarkable advantage that labor and time can be greatly reduced as compared to the can seamer in the prior art, in which the seamer was rotated by a manually operated handle and the seaming roll shaft was constrained by means of a hand tool.

Also, according to the fourth aspect of the present invention, owing to the fact that setting of a gap clearance in the vertical direction of a seaming roll shaft can be achieved easily by merely adjusting a fitting condition between a tapered bore formed in a seaming roll shaft and a center pin provided in a seaming lever even in the case where dimensions are varied delicately due to temperature variations, there is provided a remarkable advantage that labor and time necessitated for adjustment of the gap clearance can be saved.

In addition, according to the fifth aspect of the present invention, owing to the fact that replacement of a knock-out pad accompanying the change of can sizes can be carried out by a one-touch operation in a can seamer, there is provided a remarkable advantage that it is possible to spare labor and time even in a multiple can seamer.

Since many changes and modifications can be made to the above-described constructions without departing from the spirit of the present invention, it is intended that all matter contained in the above description and illustrated in the accompanying drawings shall be interpreted to be illustrative and not in a limiting sense.

What is claimed is:

1. A changing apparatus in a can seamer comprising a can seamer main body frame having a vertical center axis, a rotary frame rotatable about the vertical center axis, a plurality of can seaming mechanisms circumferentially distributed about the vertical center axis, at a constant pitch and equidistant from the vertical center axis, each said can seaming mechanism including a seaming roll shaft carried by said rotary frame, a set of two seaming rolls removably mounted on a lower end of said shaft, a rotatable can table for supporting a bottom of a can and a seaming chuck rotatable with said can table for supporting a lid of the can from above, said changing apparatus comprising:

an actuator mounted on the can seamer main body having a vertically downwardly movable actuator member for depressing the top end of one of the seaming roll shafts when the corresponding can seaming mechanism is at a stop position; and a rotational position detector detecting the rotational position of the seaming roll shafts such that the shafts can be stopped at said stop position below said actuator.

2. The changing apparatus of claim 1, wherein the seaming roll shafts are vertically movable mounted on the rotary frame and are upwardly biased such that downward movement of said actuator member moves the seaming roll shaft downwardly to a changing position.

3. The changing apparatus of claim 1, wherein said rotational position detector comprises a disc rotating proportionally to rotation of the rotary frame relative to the main body frame and an approach sensor detecting the rotary position of said disc.

4. The changing apparatus of claim 1, wherein said rotational position detector comprises a fixed position sensor on the main body frame detecting the top ends of the seaming roll shafts.

5. The changing apparatus of claim 1, wherein a drive motor drives the rotary frame in rotation relative to the main body frame, said rotational position detector and said drive motor forming part of an actuatable control means for rotating the rotary frame by one pitch to move the seaming roll shafts and stop movement when a next one of the seaming roll shaft moves under said actuator at said position in response to a single actuation of said control means.

6. The changing apparatus of claim 1, wherein said actuator is pneumatic.

7. A can seamer apparatus, comprising:

a can seamer main body frame having a vertical center axis;

a plurality of can seaming mechanisms circumferentially distributed about the vertical center axis at a constant pitch and equidistant from the vertical center axis, each said can seaming mechanism having a rotatable can table for supporting a bottom of a can, a rotatable seaming chuck for supporting a lid of the can from above, and a set of two seaming rolls pivotable on a seaming roll shaft, whereby a can covered with a can lid can be gripped between said can table and said seaming chuck and rotated about a vertical axis so that a top edge of the can and the lid are seamed by a said seaming roll;

an actuator mounted on said can seamer main body frame for depressing a top end of said seaming roll shaft; and a means for rotatably moving said can seaming mechanisms about the vertical axis pitch by pitch relative to said actuator and stopping said can seaming mechanisms at predetermined positions where said seaming roll shafts are below said actuator, said means comprising a drive motor and a seaming roll shaft rotational position detector.

8. The can seamer apparatus of claim 7, wherein said rotational position detector comprises a disc rotatably interlocked with rotation of said seaming roll shaft about the vertical center axis and an approach sensor for detecting a rotational angle of said disc.

9. The can seamer of claim 7, wherein said rotational position detector comprises a fixed position sensor detecting the top ends of said seaming roll shafts.

* * * * *